US006820873B2

(12) United States Patent
Kulpa

(10) Patent No.: US 6,820,873 B2
(45) Date of Patent: Nov. 23, 2004

(54) TRANSPORT MECHANISM FOR A MAILING MACHINE

(75) Inventor: Walter J. Kulpa, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 127 days.

(21) Appl. No.: 10/382,394

(22) Filed: Mar. 6, 2003

(65) Prior Publication Data

US 2004/0178566 A1 Sep. 16, 2004

(51) Int. Cl.[7] ..... B65H 5/02
(52) U.S. Cl. ..... 271/273
(58) Field of Search ..... 271/273

(56) References Cited

U.S. PATENT DOCUMENTS 5,333,848 A * 8/1994 Rubscha ..... 271/3.14
5,385,342 A * 1/1995 Leib ..... 271/274
5,566,933 A * 10/1996 Salancy ..... 271/273
6,041,569 A 3/2000 Freeman et al.
6,343,786 B1 * 2/2002 Gregoire et al. ..... 271/273

FOREIGN PATENT DOCUMENTS

JP 4-140248 * 5/1992

* cited by examiner

*Primary Examiner*—Donald P. Walsh
*Assistant Examiner*—Kenneth W Bower
(74) *Attorney, Agent, or Firm*—Brian A. Lemm; Angelo N. Chaclas

(57) ABSTRACT

The present invention includes apparatus and methods for feeding a mailpiece along a feed path in a mailing machine. An endless drive belt has a lower belt run adapted to feed a mailpiece in a downstream direction. A plurality of pivot arms are mounted in a sequence below the lower belt run. Each pivot arm has a respective roller mounted on a free end of the pivot arm. A respective bias mechanism associated with each pivot arm biases the pivot arm in an upward direction such that the roller contacts the lower belt run. A first pivot arm actuates a second pivot arm in a downward direction when the first pivot arm is actuated in a downward direction by a mailpiece fed by the endless belt.

31 Claims, 6 Drawing Sheets

TRANSPORT MECHANISM FOR A MAILING MACHINE

FIELD OF THE INVENTION

This invention relates generally to the field of mailing machines, and more particularly to guiding and feeding a mailpiece past a printing station.

BACKGROUND OF THE INVENTION

Generally, a mailpiece transport on a mailing machine transports envelopes and other mailpieces along a feed path so that various functions may be performed on the mailpiece at different locations along the feed path. For example, at one location along the feed path the mailpiece may be weighed, at another location the mailpiece may be sealed, and at a further location an indicium for postage may be applied to the mailpiece. Drive rollers and/or drive belts may be employed to contact the mailpiece to propel the mailpiece along the feed path.

When a drive belt is employed, structures must be provided to keep the mailpiece in contact with the drive belt. In conventional arrangements, spring-loaded pivot arms are provided along the drive belt. At a free end of each pivot arm, a roller is mounted to contact the mailpiece as the mailpiece is driven by the drive belt and to apply a force to the mailpiece so that the mailpiece is maintained in frictional contact with the drive belt. To prevent the drive belt from deflecting due to the force imparted by the pivot arm, a backup roller is provided behind the drive belt at each point where the belt is in contact with a roller mounted on a pivot arm. Each pair of rollers formed of a pivot arm roller and the corresponding backup roller constitutes a spring-loaded nip through which the mailpiece is fed by the drive belt.

A common requirement for mailing machines is that they be capable of handling mailpieces of varying sizes and thicknesses. For example, a mailing machine may be required to process mailpieces that vary in thickness from 0.007 inch to 0.75 inch. The mailpieces may also vary in length over a considerable range. The degree of compliance provided for the above-described pivot arms, and the shape of the arms, customarily take into account the varying thicknesses of the mailpieces to be processed. To prevent mailpieces from skewing while being transported, the spring-loaded nips may be set at a spacing relative to each other such that the maximum distance between two adjacent nips is less than half of the length of the shortest mailpiece to be processed by the mailing machine. As a result, a mailpiece is generally held between at least two nips while being driven by the drive belt.

In some mailing machines, mailpieces are driven past a printing station by a drive belt. At the printing station a postage indicium may be printed on the mailpiece. Ink jet printing technology is commonly employed for printing of postal indicia. Some current practices call for postage indicia to include printing of a two-dimensional barcode that indicates data relating to the dispensing of the postage for the mailpiece. Because the barcode represents part of the security system for dispensing the postage, it is necessary that the printing occur with a high degree of reliability and fidelity so that the barcode can be successfully read to verify that the postage was properly dispensed. However, if the motion of the mailpiece is disturbed while printing of the postal indicium is occurring, the surface of the mailpiece on which the printing is taking place may be buckled or otherwise distorted. This may cause the printed image to be distorted, in which case the barcode may not be properly readable.

Therefore, it would be advantageous to provide apparatus and methods that minimize the possibility that the motion of a mailpiece is disturbed while an indicium is being printed on the mailpiece.

SUMMARY OF THE INVENTION

Accordingly, an improved apparatus and method for transporting a mailpiece along a feed path in a mailing machine is provided. The improved apparatus includes an endless belt that has a lower belt run that extends in a generally horizontal direction. The belt run is adapted to feed the mailpiece in a downstream direction. The apparatus also includes a plurality of pivot arms mounted in a sequence below the lower belt run. Each pivot arm has a respective roller mounted on a free end of the pivot arm. A respective bias mechanism is associated with each pivot arm to bias the pivot arm in an upward direction such that the roller contacts the lower belt run. The plurality of pivot arms includes a first pivot arm and a second pivot arm. The second pivot arm is positioned downstream from the first pivot arm and adjacent to the first pivot arm in the sequence of pivot arms. The first and second pivot arms are configured such that the first pivot arm actuates the second pivot arm in a downward direction when the first pivot arm is actuated in a downward direction by the mailpiece that is fed by the endless belt.

For example, the second pivot arm may be mounted on a free end of a third pivot arm that is mounted downstream from the first pivot arm. The second pivot arm may extend in a substantially horizontal and upstream direction from the free end of the third pivot arm toward the free end of the first pivot arm. The second pivot arm may include a lever that extends beyond a free end of the second pivot arm to contact a lower surface of the free end of the first pivot arm. The lever may include a ramp surface on which the lower surface of the free end of the first pivot arm rides while the first pivot arm downwardly actuates the second pivot arm. The second pivot arm and the roller mounted on the free end of the third pivot arm may both be mounted on a common shaft. The bias mechanism associated with the second pivot arm may include a coil spring held between the second pivot arm and the third pivot arm. The coil spring may be in contact with a lower surface of the lever. The first pivot arm may have an upstream-facing surface that has a convex profile and the third pivot arm may have an upstream-facing surface that has a concave profile.

In another aspect, an apparatus for processing a mailpiece includes a base and a feed mechanism mounted on the base. The feed mechanism feeds the mailpiece along a feed path in a downstream direction. The feed mechanism includes a first nip positioned at a first point along the feed path. The first nip is formed by a first upper roller and a first lower roller. The feed mechanism also includes a second nip positioned at a second point along the feed path that is downstream from the first nip. The second nip is formed by a second upper roller and a second lower roller. The feed mechanism further includes a pre-opening mechanism which opens the second nip in response to the mailpiece being fed through the first nip and before the mailpiece reaches the second nip.

In still another aspect, a roller assembly includes a primary arm which has a proximal end adapted to be mounted to a support. The primary arm also has a distal end that is opposite to the proximal end. The roller assembly also includes a primary roller mounted for rotation at the distal end of the primary arm. The roller assembly further includes a secondary arm which has a proximal end that is pivotally mounted to the distal end of the primary arm. Further, the roller assembly includes a secondary roller mounted for rotation on the secondary arm.

In yet another aspect, a method is provided for feeding a mailpiece along a feed path. The method includes feeding a mailpiece through a first nip, thereby opening the first nip. The method further includes opening a second nip downstream from the first nip in response to the opening of the first nip. The opening of the second nip occurs before the mailpiece reaches the second nip.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention includes apparatus and methods for feeding a mailpiece along a feed path in a mailing machine. A first pivot arm downwardly actuates a following pivot arm so that the nip corresponding to the following pivot arm is pre-opened while a mailpiece is in contact with the first pivot arm and before the mailpiece reaches the following pivot arm. This may reduce the possibility of the mailpiece being disturbed in its motion upon encountering the nip which corresponds to the following pivot arm. The following pivot arm may be near a printing station where a postage indicium is printed on the mailpiece.

Figure 1:
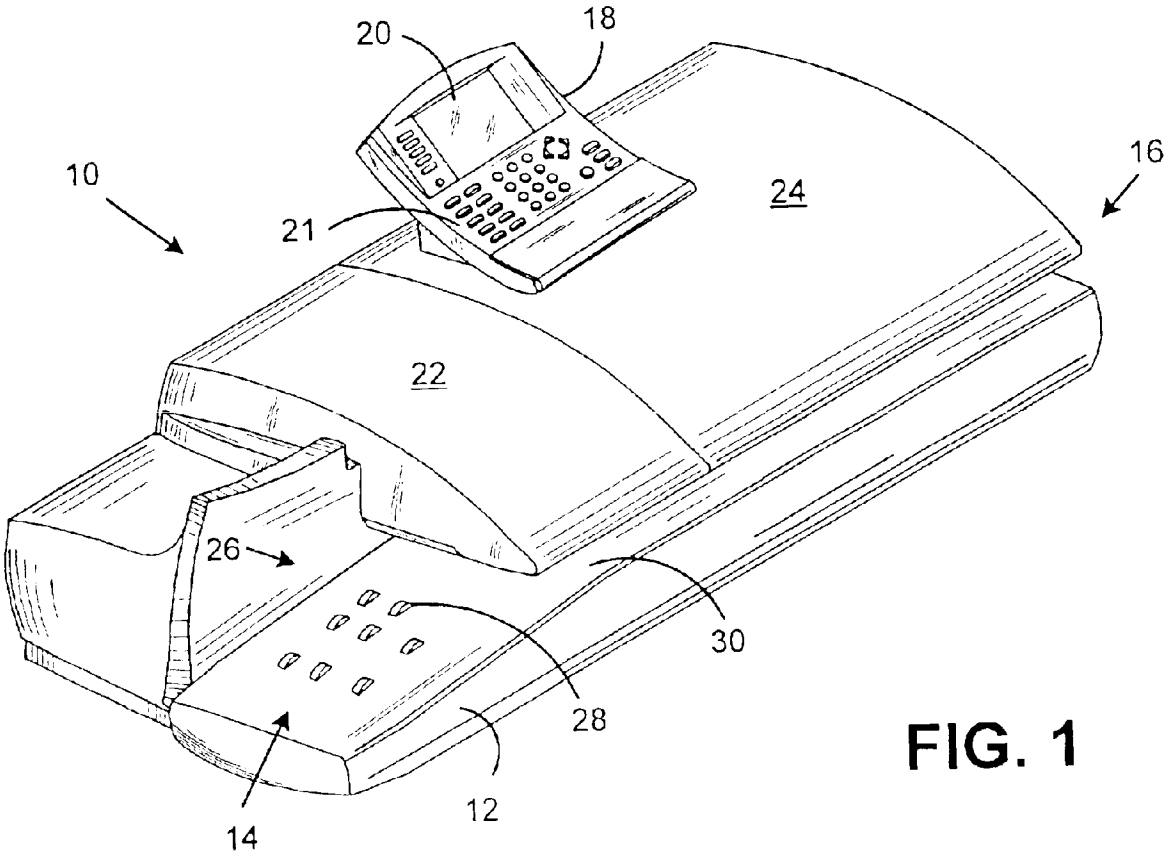
FIG. 1 is a perspective view of a typical mailing machine constructed and arranged in accordance with the principles of the present invention.

Referring now to the drawings, and particularly to FIG. 1, the reference numeral 10 indicates generally a typical mailing machine which incorporates the principles of the present invention. The mailing machine 10 includes a base unit generally designated by the reference numeral 12. The base unit 12 has a mailpiece infeed end, generally designated by the reference numeral 14 and a mailpiece outfeed end, designated generally by the reference numeral 16.

Cover members 22, 24 are pivotally mounted on the base 12 and are moveable between a closed position shown in FIG. 1 and an open position (not shown). A control unit 18, having one or more input/output devices, such as, for example, display 20 and keyboard 21, is suitably mounted on the cover 24 so as to be conveniently accessible to an operator. In the open position of the cover members 22, 24 various operating components and parts are exposed for service and/or repair as needed. A mailpiece transport mechanism which embodies principles of the present invention and which will be described in more detail below is housed under the cover member 24.

A mailpiece stacking location 26 at the infeed end 14 of the base 12 may hold a stack of mailpieces. Nudger rollers 28 are provided to convey single mailpieces across a deck 30 toward the mailpiece transport mechanisms which are under the cover members 22, 24. The mailpieces may be singulated and sealed on the way to, or while being transported by, the mailpiece transport mechanism under cover member 22. The singulating and sealing operations may be performed by mechanisms which are not visible in the drawing. These mechanisms may be provided in accordance with conventional practices.

Figure 2:
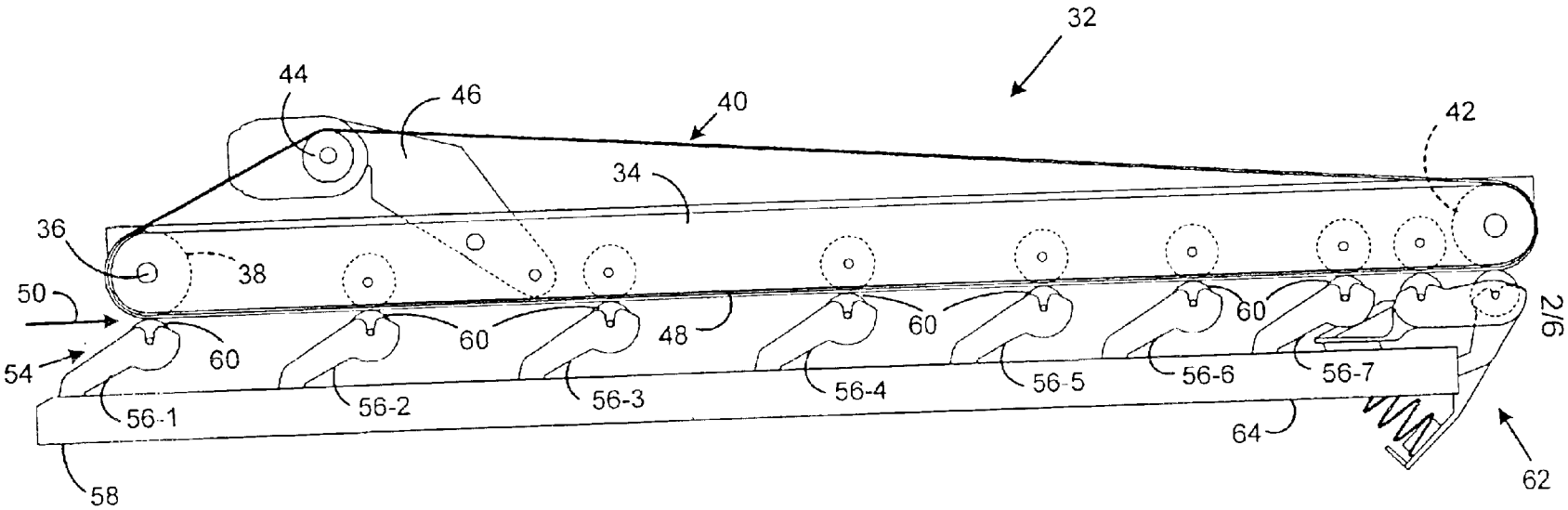
FIG. 2 is a front elevation of a portion of the mailing machine shown in FIG. 1, with parts removed to show details of a mailpiece transport mechanism.

FIG. 2 is a partial front elevational view of the mailpiece transport mechanism (generally designated by reference numeral 32) that is hidden under the cover member 24 shown in FIG. 1. Continuing to refer to FIG. 2, the mailpiece transport mechanism 32 includes an elongate frame 34 which is pivotally mounted on a shaft 36. The shaft 36 is mounted in a conventional manner to the base unit 12 (FIG. 1, not shown in FIG. 2). A drive roller 38 is fixedly mounted on the shaft 36 for rotation therewith. An endless belt 40 extends around the drive roller 38 and an idler roller 42 mounted adjacent the other end of the frame 34. The belt 40 also passes over a tensioning roller 44 mounted on the free end of a spring-loaded arm 46 which is suitably mounted on the frame 34 so as to maintain proper operating tension on the belt 40. The belt 40 includes a lower belt run 48 which extends in a generally horizontal orientation and feeds mailpieces along a feed path (generally indicated by an arrow 50) defined by the mailpiece transport mechanism 32.

A sequence (generally indicated by reference numeral 54) of spring-loaded pivot arms 56 are mounted to a support 58 along the feed path 50 and below the lower belt run 48. A respective pressure roller 60 is mounted on the free end of each of the pivot arms 56. The pivot arms 56 and pressure rollers 60 are provided to maintain the mailpieces in frictional contact with the belt run 48 as the mailpieces are fed along the feed path. The pivot arms 56 and rollers 60 may all be constructed and mounted in accordance with conventional practices.

A compound roller assembly 62 is provided in accordance with principles of the present invention and is mounted at a downstream end 64 of the support 58. As will be seen from subsequent discussion, the roller assembly 62 is acted upon by a pivot arm 56-7 which is mounted immediately upstream from the roller assembly 62. Details and functioning of the roller assembly 62 will be described with reference to FIGS. 3-6.

Figure 3:
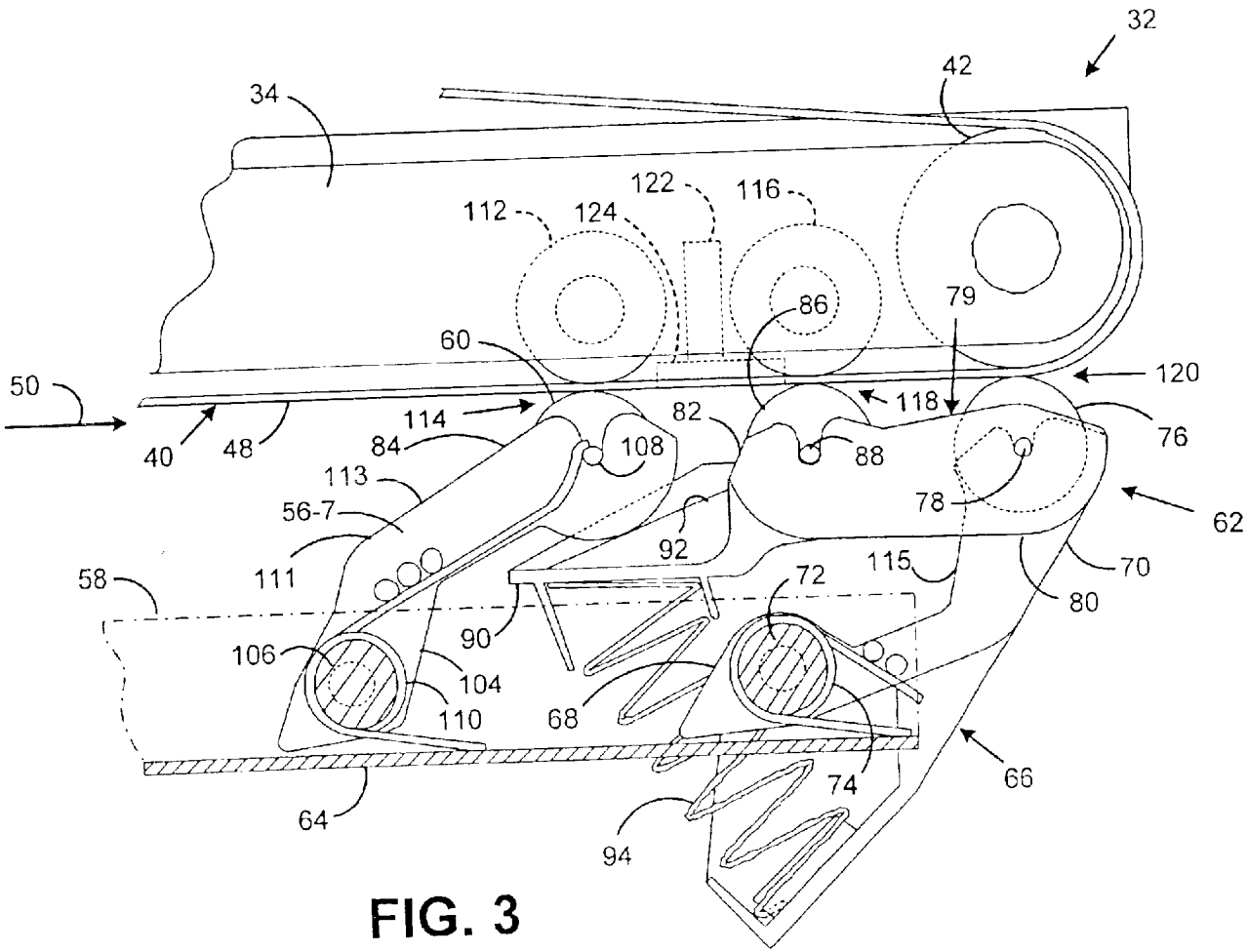
FIG. 3 is a front elevation presented on a larger scale to show some details of the mailpiece transport mechanism shown in FIG. 2.
Figure 4:
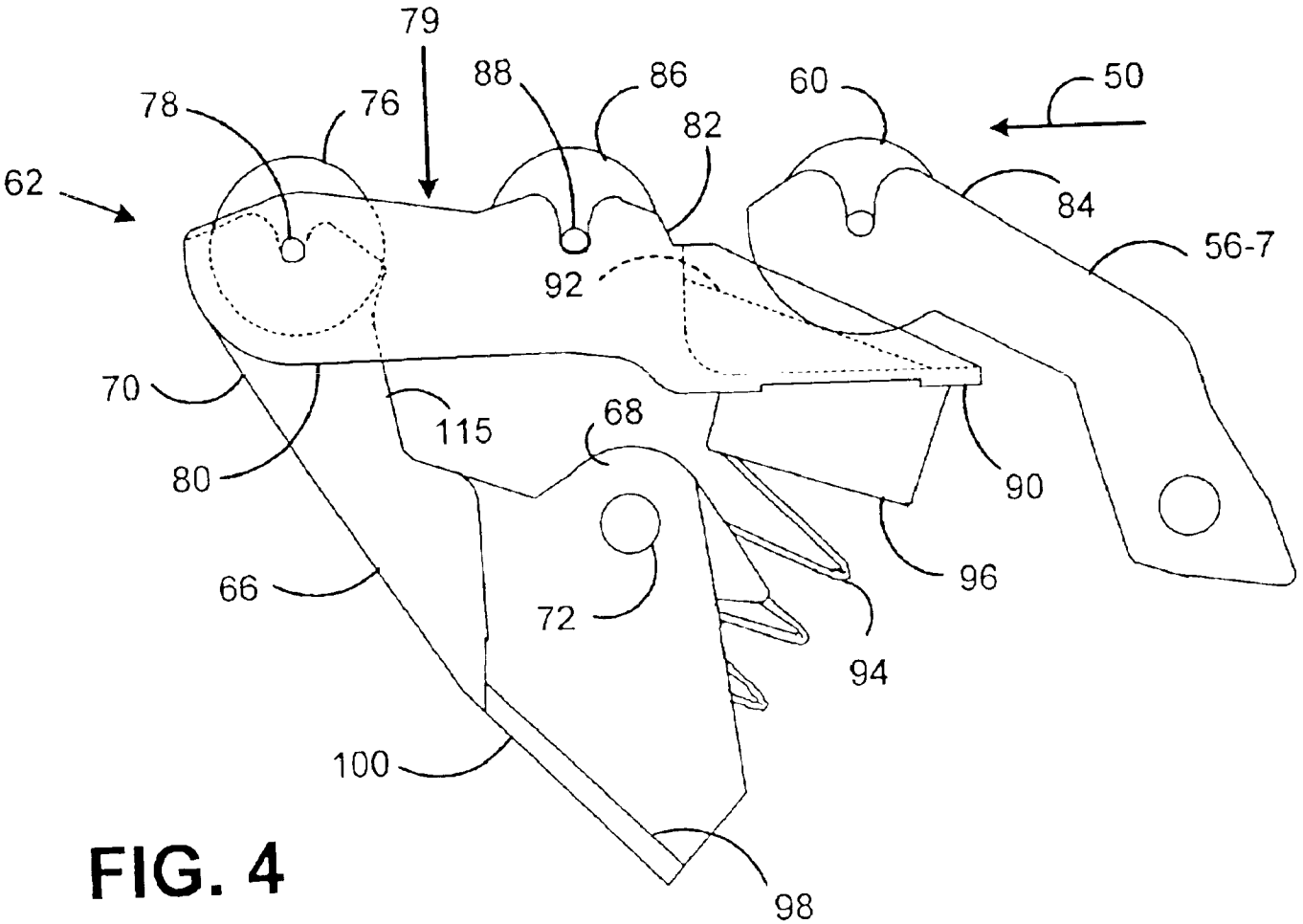
FIG. 4 is a rear elevation showing only some of the components of the mailpiece transport mechanism that are visible in FIG. 3.
Figure 5:
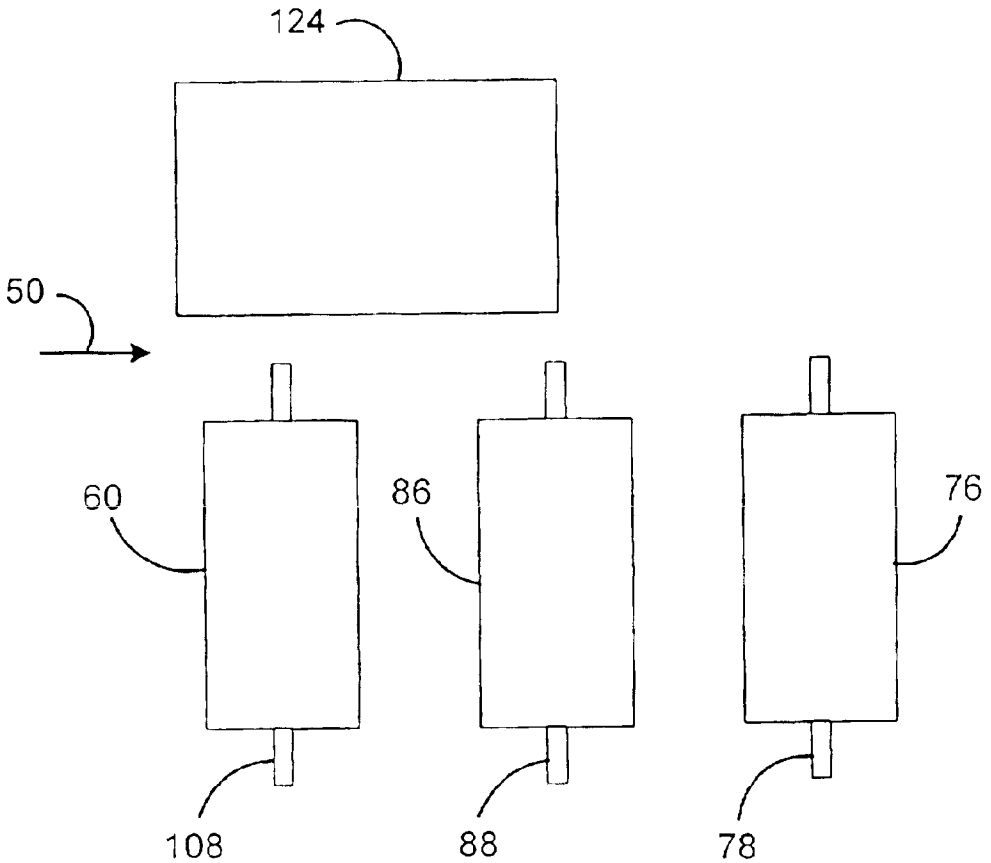
FIG. 5 is a partial schematic plan view that illustrates a relationship between pivot arm rollers shown in FIGS. 3 and 4 and a mailpiece ski.

FIG. 3 is a front elevational view on a larger scale than FIG. 2 showing details of the roller assembly 62 and of a downstream end 64 of the mailpiece transport mechanism 32. FIG. 4 is a rear view showing the roller assembly 62 and adjoining pivot arm 56-7 in isolation. (The support 58 is shown in phantom in FIG. 3 to allow for a clear depiction of aspects of the roller assembly 62 and the pivot arm 56-7.)

The roller assembly 62 includes a primary pivot arm 66 which has a proximal end 68 and a distal end (free end) 70. The primary pivot arm 66 may be considered to complete the sequence 54 (FIG. 2) of pivot arms, and is mounted by its proximal end 68 to the support 58 (FIG. 3) via a pivot shaft 72. A biasing mechanism, and in particular a torsion spring 74, is associated with the primary pivot arm 66 and the pivot shaft 72 to bias the pivot arm 66 in an upward direction (counter-clockwise as viewed in FIG. 3).

The roller assembly 62 also includes a primary pressure roller 76 mounted for rotation on a shaft 78 at the distal end 70 of the primary pivot arm 66. The roller 76 may be identical in shape, size and construction to the conventional pressure rollers 60 mounted on the pivot shafts 56. For example, all of the pressure rollers may be 1 5/16 inches long with a ¾ inch diameter.

The roller assembly 62 further includes a secondary pivot arm 79 which has a proximal end 80 and a distal end (free end) 82. The pivot arm 79 may be considered a penultimate member of the pivot arm sequence 54. The proximal end 80 of the secondary pivot arm 79 is pivotally mounted to the distal end 70 of the primary pivot arm 66 via the same shaft 78 by which the primary pressure roller 76 is mounted to the primary pivot arm 66. Thus the shaft 78 is a common shaft for the secondary pivot arm 79 and the primary pressure roller 76. The secondary pivot arm 79 extends in a generally horizontal and upstream direction from the distal end 70 of the primary pivot arm 66 toward the free end (distal end) 84 of the next upstream pivot arm 56-7.

Also included in the roller assembly 62 is a secondary pressure roller 86 mounted for rotation on a shaft 88 at the distal end 82 of the secondary pivot arm 79. The secondary pressure roller 86 may be of conventional size, shape and construction and identical to the rollers 60, 76.

The secondary pivot arm 79 also includes a lever portion 90 that extends in an outboard direction (i.e., away from the pivot point defined by the shaft 78) beyond the secondary roller 86 and toward the upstream pivot arm 56-7. The lever portion 90 includes a ramp 92 which may be in contact with a lower surface of the free end 84 of the pivot arm 56-7.

A biasing mechanism, specifically a coil spring 94, is associated with the secondary pivot arm 79 to bias the secondary pivot arm 79 in an upward direction (clockwise as viewed in FIG. 3). The coil spring has an upper end that is held by a spring mounting surface 96 (FIG. 4) at a distal end of the lever portion 90 of the secondary pivot arm 79, and a lower end that is held by a spring mounting surface 98 on a lower extension 100 of the primary pivot arm 66. The extension 100 of the primary pivot arm 66 is adjacent the pivot shaft 72 at the proximal end of the primary pivot arm 66. The coil spring 94 is held between the pivot arms 66 and 79 in such a fashion as to define a curved locus. The coil spring 94 may be mounted in a conventional manner to the mounting surfaces 96, 98.

The center-to-center distance from the roller 60 mounted on the pivot arm 56-7 to the primary roller 76 of the roller assembly 62 may be substantially 2⅜ inches (which is a typical distance between the last two rollers of a conventional mailpiece transport mechanism). The secondary roller 86 of the roller assembly 62 may be positioned substantially half-way between the rollers 60, 76.

Certain details of the pivot arm 56-7 will also now be described with reference to FIG. 3. The pivot arm 56-7 is of conventional construction and has the above-mentioned distal end 84, as well as a proximal end 104, by which the pivot arm 56-7 is pivotally mounted to the support 58 via a pivot shaft 106. The above-mentioned pressure roller 60 is rotationally mounted to the distal end 84 of the pivot arm 56-7 via a shaft 108. A biasing mechanism, namely a torsion spring 110, biases the pivot arm 56-7 in an upward direction (counter-clockwise as viewed in FIG. 3).

It will be observed that the pivot arm 56-7 has an upstream-facing surface 111 which, like the other pivot arms 56, has a convex profile including a ramp surface 113 to aid in guiding mailpieces to the roller 60. By contrast, an upstream-facing surface 115 of the primary pivot arm 66 of the roller assembly 62 has a concave profile to accommodate downward pivoting motion, as described below, of the secondary pivot arm 79. An upper surface of the secondary pivot arm 79 between the rollers 86, 76 may function as a ramp surface to aid in guiding mailpieces to the roller 76.

A backup roller 112 is mounted on the frame 34 above and in contact with the lower belt run 48 at the locus of the pressure roller 60 mounted on the pivot arm 56-7. The roller 112 forms a first nip 114 with the roller 60, with the roller 60 being the lower roller of the first nip 114 and the roller 112 being the upper roller of the first nip 114. Another backup roller 116 is mounted on the frame 34 above and in contact with the lower belt run 48 at the locus of the secondary pressure roller 86 of the roller assembly 62. The roller 116 forms, with the roller 86, a second nip 118 that is downstream from the first nip 114 along the feed path 50. The roller 86 is the lower roller of the second nip 118 and the roller 116 is the upper roller of the second nip 118. The lower belt run 48 is interposed between the rollers 112, 60 and between the rollers 116, 86.

The primary pressure roller 76 of the roller assembly 62 is positioned relative to the above-mentioned idler roller 42 so as to form a third nip 120 that is downstream from the second nip 118. The roller 76 is the lower roller of the third nip 120 and the roller 42 is the upper roller of the third nip 120.

A printing station 122, shown in phantom, is positioned to the rear of the belt 40 and just upstream from the second nip 118. At the printing station 122 a print element (not separately shown) such as an ink jet print head prints information such as a postage indicia on a mailpiece fed along the feed path 50 by the mailpiece transport mechanism 32. As noted above, the postage indicium may include a two-dimensional barcode which is required to be printed with a high degree of reliability and fidelity to insure that postal revenue security data included in the barcode can be successfully read if necessary.

A registration plate 124 (shown in plan view in relation to the rollers 60, 86, 76 in FIG. 5; also partially shown in phantom in FIG. 3) is provided adjacent the belt 40 and under the print station 122. The registration plate 124 defines a plane at which each mailpiece is presented so that the upper surface of the mailpiece is predictably and repeatably positioned for printing at the printing station 122 so that a high quality indicia is printed on the mailpiece.

Figure 6:
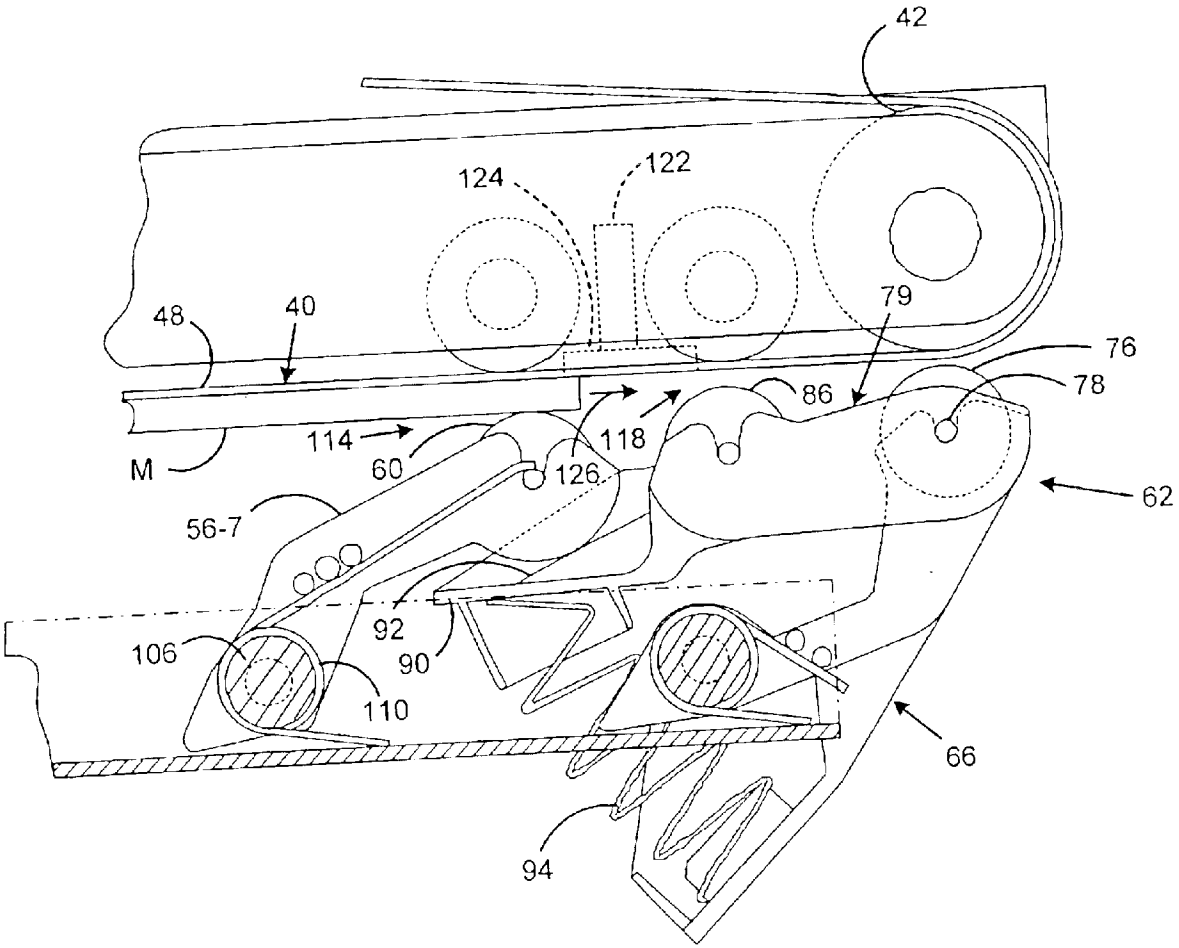
FIG. 6 is a view similar to FIG. 3, showing the mailpiece transport mechanism with a mailpiece that is being fed through the mechanism.

Operation of the mailpiece transport mechanism 32 will now be described, with reference to FIGS. 3 and 6.

When no mail piece is present at the first, second and third nips, 114, 118, 120, the rollers 60, 86, 76 and the pivot arms 56-7, 79 and 66 are positioned as shown in FIG. 3, with the nips 114, 118, 120 closed. When a relatively thin mailpiece is fed through the feed path, there may be little or no downward deflection of the arms 56-7, 79, 66, as the minimal thickness of the mailpiece may be absorbed by compliance of the belt 40 and the rollers 112, 60, 116, 86, 42 and 76. However, when a rather thick mailpiece is fed through the feed path, all of the arms 56, 79, 66 are deflected downwardly, resulting in downward pivoting of the arms, as the mailpiece progress along the feed path. FIG. 6 is a view similar to FIG. 3, but showing a condition of the mailpiece processing mechanism 32 when a rather thick mailpiece M is present in the first nip 114 but has not yet reached the second nip 118. An arrow 126 indicates motion of the mailpiece M as fed by the mailpiece transport mechanism 32.

The entry of the thick mailpiece M into the first nip 114 causes the pivot arm 56-7 to pivot downwardly (clockwise in FIG. 6) against the biasing force of the torsion spring 110, thereby opening the first nip 114. Because a lower surface of the free end of the pivot arm 56-7 is in contact with the ramp 92 on the lever portion 90 of the secondary pivot arm 79 of the roller assembly 62, the downward pivoting of the pivot arm 56-7 actuates downward (counter-clockwise) pivoting of the secondary pivot arm 79 about the shaft 78, thereby lowering the secondary roller 86 from contact with the belt 40 to pre-open the second nip 118. That is, the second nip 118 is opened by interaction between the pivot arms 56-7, 79 before the mailpiece M reaches the second nip 118 and before the mailpiece M contacts the roller 86, the pivot arm 79 or any other portion of the roller assembly 62. The downward pivotal actuation of the pivot arm 79 is performed against the upward biasing force of the coil spring 94 and causes compression of the length of the coil spring 94. At the same time, the lower surface of the free end of the pivot arm 56-7 rides on the ramp 92.

Because the second nip 114 is already open when the mailpiece M reaches the second nip, the possibility that the motion of the mailpiece may be disturbed, while the mailpiece passes through the second nip and while being transported past the printing station 122, is reduced or eliminated. Also, the leading edge of the mailpiece is supported by the second nip 114 by the time when printing of the postage indicium begins. These factors make it less likely that the upper surface of the mailpiece presented for printing will be distorted. Consequently, the reliability and fidelity of the printing of the postage indicium is enhanced.

A further advantage of the arrangement shown in FIG. 3 is that the presence of the second nip 118 at the downstream edge of the registration plate 124 helps to prevent the mailpiece from skewing due to the drag provided by the registration plate 124. Also, the close spacing between the rollers 76, 86 helps to stabilize the mailpiece, and aids in preventing skew, as the mailpiece exits from the mailpiece transport mechanism 32. This tends to promote satisfactory stacking of mailpieces sequentially outfed from the mailpiece transport mechanism 32.

According to an alternative embodiment, the lever portion 90 of the pivot arm 79 may be omitted and replaced with a suitable lever on the pivot arm 56-7, in which case a suitable contact surface for being driven by the lever on the arm 56-7 may be provided on the arm 79.

As another alternative, a torsion spring may be employed instead of the coil spring 94 to upwardly bias the arm 79. Spring 94 is preferable, however, as the lower end of spring 94 applies a force to arm 66 near pivot 72. This applies only a small moment to arm 66 whereas a torsion spring would apply a large moment that would affect the force at roller 76.

As still another alternative, the arm 79 intervening between the arms 56-7 and 66 may be pivotally mounted on the support 58 rather than on the arm 66.

The pivot arms 56 upstream from the pivot arm 56-7 may be increased or decreased in number or may be eliminated, depending on the desired length of the feed path 50 and also depending on the lengths of mailpieces to be transported by the mailpiece transport mechanism 32. It is not necessary that all of the pivot arms 56, 66 be mounted on the same structural member.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. For example, the primary roller of the roller assembly and the secondary arm need not share a common shaft but rather could have separate shafts or mounting structures provided therefor. In addition, the pre-opening of the second nip could be performed by a separate motor/actuator in response to sensor output rather than directly actuating the pre-opening of the second nip by action of the upstream pivot arm. Other variations relating to implementation of the functions described herein can also be implemented. Accordingly, other embodiments are within the scope of the following claims.

What is claimed is:

1. A device for processing a mailpiece comprising:

an endless belt having a lower belt run that extends in a generally horizontal direction and is adapted to feed the mailpiece in a downstream direction; and a plurality of pivot arms mounted in a sequence below the lower belt run of the endless belt, each pivot arm having a respective roller mounted on a free end of the pivot arm and a having a respective bias means associated with the pivot arm for biasing the pivot arm in an upward direction such that the roller contacts the lower belt run of the endless belt;

wherein the plurality of pivot arms includes a first pivot arm and a second pivot arm positioned downstream from the first pivot arm and adjacent to the first pivot arm in the sequence of pivot arms, the first and second pivot arms being configured such that the first pivot arm actuates the second pivot arm in a downward direction when the first pivot arm is actuated in a downward direction by the mailpiece fed by the endless belt.

2. The device according to claim 1, wherein the plurality of pivot arms includes a third pivot arm mounted downstream from the first pivot arm and having the second pivot arm mounted on a free end of the third pivot arm.

3. The device according to claim 2, wherein the second pivot arm extends in a substantially horizontal and upstream direction from the free end of the third pivot arm toward a free end of the first pivot arm, the second pivot arm including a lever that extends beyond a free end of the second pivot arm to contact a lower surface of the free end of the first pivot arm.

4. The device according to claim 3, wherein the lever includes a ramp surface on which the lower surface of the free end of the first pivot arm rides while the first pivot arm downwardly actuates the second pivot arm.

5. The device according to claim 2, wherein the second pivot arm and a roller mounted on the free end of the third pivot arm are mounted on a common shaft.

6. The device according to claim 2, wherein the bias means associated with the second pivot arm includes a coil spring held between the second pivot arm and the third pivot arm.

7. The device according to claim 6, wherein the second pivot arm includes a lever that extends beyond a free end of the second pivot arm and the coil spring is in contact with a lower surface of the lever.

8. The device according to claim 2, wherein the first pivot arm has an upstream-facing surface that has a convex profile and the third pivot arm has an upstream-facing surface that has a concave profile.

9. A device for processing a mailpiece comprising:

a base; and feed means mounted on the base for feeding the mailpiece along a feed path in a downstream direction, the feed means including:

a first nip positioned at a first point along the feed path and formed by a first upper roller and a first lower roller;

a second nip positioned at a second point along the feed path that is downstream from the first nip, the second nip being formed by a second upper roller and a second lower roller; and pre-opening means for opening the second nip in response to the mailpiece being fed through the first nip and before the mailpiece reaches the second nip.

10. The device according to claim 9, wherein the second lower roller is mounted on a second nip arm, the pre-opening means including a lever mounted on the second nip arm, the lever extending away from the second lower roller in an upstream direction that is generally opposite to said downstream direction.

11. The device according to claim 10, wherein the pre-opening means further includes a first nip arm having a proximal end at which the first nip arm is pivotally mounted to a support and a distal end at which the first lower roller is rotationally mounted, the first nip arm being in contact with the lever to cause the second nip arm to pivot downwardly in response to downward pivoting of the first nip arm.

12. The device according to claim 11, wherein the downward pivoting of the first nip arm is actuated by the feed means feeding the mailpiece through the first nip.

13. The device according to claim 12, wherein the feed means also includes a third nip positioned at a point along the feed path that is downstream from the second nip, the third nip being formed by a third upper roller and a third lower roller;

the third lower roller being mounted at a distal end of a third nip arm which has a proximal end at which the third nip arm is pivotally mounted to the support;

wherein the second nip arm has a proximal end opposite to the lever, the second nip arm being pivotally mounted by its proximal end to the distal end of the third nip arm.

14. The device according to claim 13, wherein the feed means further includes:

first biasing means for biasing the first nip arm in an upward direction;

second biasing means for biasing the second nip arm in an upward direction; and third biasing means for biasing the third nip arm in an upward direction.

15. The device according to claim 14, wherein the second biasing means includes:

a coil spring; and spring mounting means for mounting the coil spring such that the coil spring defines a curved locus.

16. The device according to claim 15, wherein the spring mounting means includes:

a first mounting surface at the proximal end of the third nip arm adapted to hold a first end of the coil spring; and a second mounting surface at a distal end of the lever adapted to hold a second end of the coil spring.

17. The device according to claim 13, wherein:

the first nip arm has an upstream-facing surface that has a convex profile; and the third nip arm has an upstream-facing surface that has a concave profile.

18. The device according to claim 11, wherein the lever has a ramp surface on which the distal end of the first nip arm rides as the first nip arm and the second nip arm downwardly pivot.

19. The device according to claim 9, wherein the feed means includes a driven belt having a belt run that is interposed between the first upper roller and the first lower roller, and between the second upper roller and the second lower roller.

20. A roller assembly comprising:

a primary arm having a proximal end adapted to be mounted to a support and a distal end opposite to the proximal end;

a primary roller mounted for rotation at the distal end of the primary arm;

a secondary arm having a proximal end pivotally mounted to the distal end of the primary arm; and a secondary roller mounted for rotation on the secondary arm.

21. The roller assembly according to claim 20, wherein the secondary arm includes a lever formed at a distal end of the secondary arm that is opposite to the proximal end of the secondary arm, the secondary roller being mounted between the lever and the proximal end of the secondary arm.

22. The roller assembly of claim 21, further comprising a first shaft mounted at the distal end of the primary arm, the primary roller being rotationally mounted on the first shaft, the secondary arm being pivotally mounted on the first shaft.

23. The roller assembly of claim 22, further comprising:

a second shaft to which the proximal end of the primary arm is mounted;

a torsion spring on the second shaft for biasing the primary arm in an upward direction; and a coil spring held between a first spring mounting surface provided adjacent the second shaft on the primary arm and a second spring mounting surface formed on the lever of the secondary arm, the coil spring for biasing the secondary arm in an upward direction.

24. A device for processing a mailpiece comprising:

feed means for feeding the mailpiece along a feed path;

a support extending parallel to and below the feed path; and a roller assembly including:

a primary arm having a proximal end mounted to the support and a distal end opposite to the proximal end;

a primary roller mounted for rotation at the distal end of the primary arm;

a secondary arm having a proximal end pivotally mounted to the distal end of the primary arm; and a secondary roller mounted for rotation on the secondary arm.

25. The device according to claim 24, wherein the secondary arm includes a lever formed at a distal end of the secondary arm that is opposite to the proximal end of the secondary arm, the secondary roller being mounted between the lever and the proximal end of the secondary arm.

26. The device according to claim 25, wherein the roller assembly also includes a first shaft mounted at the distal end of the primary arm, the primary roller being rotationally mounted on the first shaft, the secondary arm being pivotally mounted on the first shaft.

27. The device according to claim 26, wherein the roller assembly also includes:

a second shaft by which the proximal end of the primary arm is mounted to the support;

a torsion spring on the second shaft for biasing the primary arm in an upward direction; and a coil spring held between a first spring mounting surface provided adjacent the second shaft on the primary arm and a second spring mounting surface formed on the lever of the secondary arm, the coil spring for biasing the secondary arm in an upward direction.

28. A method for feeding a mailpiece along a feed path, the method comprising:

feeding the mailpiece through a first nip, thereby opening the first nip; and opening a second nip downstream from the first nip in response to the opening of the first nip, the opening of the second nip occurring before the mailpiece reaches the second nip.

29. The method of claim 28, wherein the opening of the first nip includes downwardly pivoting a first arm, and the opening of the second nip includes actuating a second arm with the first arm.

30. The method of claim 29, wherein the actuating of the second arm with the first arm includes pressing the second arm at a point on the second arm that is outboard from a roller mounted on the second arm.

31. The method of claim 29, wherein the opening of the second nip includes pivoting the second arm about a free end of a third arm.

* * * * *